United States Patent [19]

Peterson

[11] Patent Number: 4,697,653

[45] Date of Patent: Oct. 6, 1987

[54] DIAMOND SETTING IN A CUTTING TOOTH IN A DRILL BIT WITH AN INCREASED EFFECTIVE DIAMOND WIDTH

[75] Inventor: Lynn Peterson, West Jordan, Utah

[73] Assignee: Eastman Christensen Company, Salt Lake City, Utah

[21] Appl. No.: 837,546

[22] Filed: Mar. 7, 1986

[51] Int. Cl.[4] ..... E21B 10/46

[52] U.S. Cl. ..... 175/329; 51/295; 76/108 A; 175/410

[58] Field of Search ..... 175/329, 330, 410, 379; 76/108 A; 51/309, 295

[56] References Cited

U.S. PATENT DOCUMENTS

| | | | |
|---|---|---|---|
| 1,939,991 | 12/1933 | Krusell | 175/330 |
| 4,190,126 | 2/1980 | Kabashima | 175/379 |
| 4,499,959 | 12/1985 | Grappendorf et al. | 175/330 |
| 4,529,047 | 7/1985 | Meskin et al. | 175/329 |
| 4,586,574 | 5/1986 | Grappendorf | 175/329 |

FOREIGN PATENT DOCUMENTS

| | | | |
|---|---|---|---|
| 1020565 | 5/1983 | U.S.S.R. | 175/329 |

OTHER PUBLICATIONS

"GEOSET Drill Diamond", General Electric, Sep. 1981.

*Primary Examiner*—James A. Leppink

*Assistant Examiner*—Hoang E. Dang

*Attorney, Agent, or Firm*—Beehler, Pavitt, Siegemund, Jagger, Martella & Dawes

[57] ABSTRACT

A diamond cutting tooth for use in a petroleum drag bit is provided with an extended and expanded effective diamond cutting surface by providing a linear sequence of triangular prismatic, synthetic, polycrystalline, diamond cutting elements generally along the line of direction of cutting within each tooth. Each element is offset from the preceding element in the sequence in a direction nonparallel to the line of cutting. More particularly, equilateral triangular prismatic diamond elements are laid within a V-shaped groove within a mold from which the cutting tooth is molded through conventional infiltration matrix techniques. The apical opening of the groove is 70 degrees, whereas the apical extent of each of the triangular apexes is 60 degrees. Each triangular element is laid on one side or other of the longitudinal groove. Matrix metal or binder is filled in the groove between the diamond elements thus forming a diamond cutting tooth having an effective apical dihedral angle of 70 degrees while using only 60-degree triangular prismatic elements. Worn triangular prismatic elements can be particularly adapted to this tooth structure by orienting at least one worn portion of each triangular element oriented toward the interior of the tooth with the remaining unworn point or points disposed nearest the exterior of the cutting tooth.

16 Claims, 15 Drawing Figures

FIG. 3
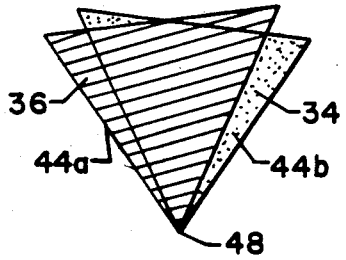
FIG. 7
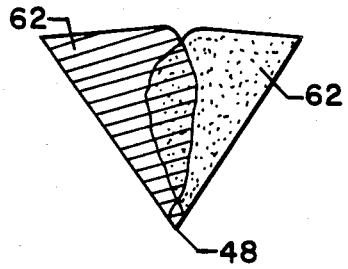
FIG. 9
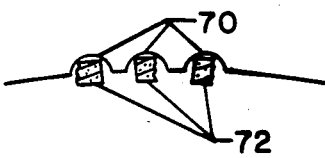
FIG. 10
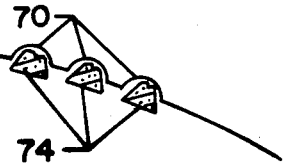
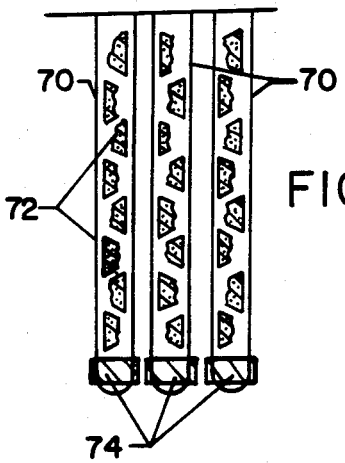
FIG. 11
FIG. 2
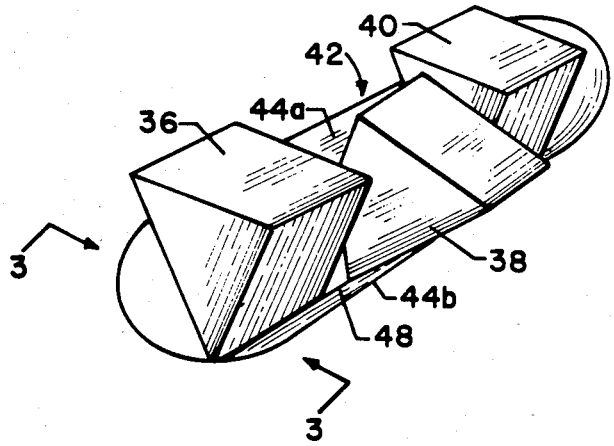
FIG. 5a NEW
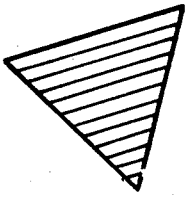
FIG. 5b 2 POINT
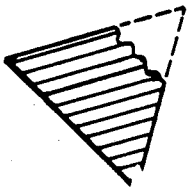
FIG. 5c 1 POINT
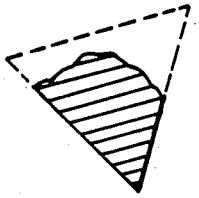
FIG. 5d KICKER
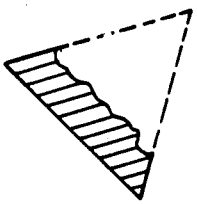
FIG. 5e SCRAP
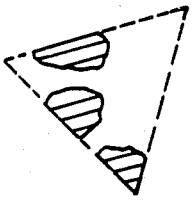

DIAMOND SETTING IN A CUTTING TOOTH IN A DRILL BIT WITH AN INCREASED EFFECTIVE DIAMOND WIDTH

BACKGROUND OF THE INVENTION

1. FIELD OF THE INVENTION

The present invention relates to the field of earth boring tools and more particularly to rotating or drag bits incorporating diamond cutting elements.

2. Description of the Prior Art

A number of improved diamond cutting tooth designs for use in rotating or drag bits have been devised by assignee of the present application, Norton Christensen, Inc. of Salt Lake City and sold under the trademark BALLASET. A number of these designs have incorporated synthetic diamond elements which are prismatic triangles and are manufactured by the General Electric Company under the trademark GEOSET. Examples of such tooth designs can be found in U.S. Patents Grappendorf et. al., "Tooth Configuration for Earth Boring Bit", U.S. Pat. No. 4,499,959 (1985); Meskin et. al., "Cutting Tooth and Rotating Bit Having Fully Exposed Polycrystalline Diamond,' U.S. Pat. No. 4,529,047 (1985); Grappendorf, "Diamond Cutting Element in a Rotary Bit, " U.S. Pat. No. 4,491,188 (1985); Link, "An Improved Diamond Rotating Bit," U.S. Pat. No. 4,550,790 (1985); and Mengel et. al., "Tooth Design to Avoid Shearing Stresses,' U.S. Pat. No. 4,515,226 (1985).

One of the design features addressed by each of the prior art designs has been the means of raising and exposing the diamond above the surface of a drill bit in a manner such that the triangular prismatic diamond element, which may be as small as one or three per carat, will be securely retained on the face of the bit under the tremendous stresses encountered in the drilling operation. It is also recognized that in many applications the more diamond that can be effectively exposed to cutting action, the more efficient and aggressive the cutting will be.

However, the size of thermally stable synthetic diamond is limited with the largest commercially available thermally stable GEOSETS being in the range of one per carat size.

Therefore, what is needed is a method and apparatus whereby the limitations of the size of thermally stable synthetic diamond elements can be overcome.

BRIEF SUMMARY OF THE INVENTION

The invention is a cutting tooth for use in a drill bit. The tooth is characterized by a cutting direction defined by operation or rotation of the drill bit. The invention comprises a body, and a plurality of cutting elements disposed within the body. The plurality of cutting elements forms a sequence of elements extending along the cutting direction of the cutting tooth. Each cutting element of the sequence includes at least a portion of the element extending in a nonparallel direction to the cutting direction and having a nonoverlapping projection in the cutting direction with respect to the preceding cutting element within the sequence to define a nonoverlapping extent of the element. By reason of this combination of elements, the effective area of the cutting elements made available for cutting action within the tooth is substantially increased over that area available from a single one of the cutting elements.

In the illustrated embodiment the body is composed of metal matrix and each of the plurality of cutting elements is separated one from each other by a thickness of the metal matrix. In any case the plurality of cutting elements is separated by a portion of the body along the cutting direction. Each cutting element is polycrystalline synthetic diamond. At least two of the cutting elements have a triangular prismatic shape, and the apical edge of the two triangular prismatic shaped elements are disposed within the body so that they are parallel to each other.

More particularly at least one apical edge of each the plurality of triangular prismatic elements lies generally on a line. Each of the remaining apical edges of the triangular prismatic elements are nonaligned with at least one other one of the plurality of triangular prismatic elements.

In another embodiment the body has an exterior surface and an interior volume, and at least two of the cutting elements are elements having at least one worn portion. Each element is disposed within the body to orient the worn portion within the body away from the exterior surface of the body so that only unworn portions comprise the nonoverlapping extent of each of the the elements.

At least two of the cutting elements are triangular prismatic elements characterized by three apical dihedral edges with at least one of the dihedral edges worn away. The worn elements are disposed within the body to orient the at least one worn-away apical edge into the interior volume of the body.

The invention can also be characterized as a cutting tooth for use in a drill bit comprising a body having an exterior and interior and characterized by a line of cutting defined by the direction of movement of the body when the drill bit is drilling. A plurality of cutting elements are disposed within the body in a sequence along the line of cutting. Each cutting element is offset with respect to the preceding cutting element to expose at least a portion of the cutting element beyond the preceding cutting element as viewed along the line of cutting. As a result the effective area of the plurality of cutting elements is substantially increased over that available from a single one of the cutting elements.

The invention can still further be characterized as a method for fabricating a cutting tooth with an enhanced cutting area comprising the step of providing a sequence of cutting elements. The sequence of cutting elements forms an array extended in the line of direction of cutting of the tooth. Each cutting element is offset from at least one preceding cutting element in a direction nonparallel to the line of cutting. The method includes the step of fixing the sequence of offset cutting elements to form a rigid array.

More particularly, the step of providing comprises the steps of disposing the cutting elements within a mold cavity, and alternating disposition of the cutting elements within the mold cavity in at least two opposing directions. The mold cavity defines an opening of greater angular extent than the corresponding portion of the cutting element disposed into contact with the mold cavity.

In another embodiment, in the step of providing the sequence of cutting elements, each element includes a wornaway portion and each element is disposed in the sequence with the worn-away portion opposing the direction of offset.

BRIEF DESCRIPTION OF THE DRAWINGS

FIG. 2 is a simplified diagrammatic diagram in perspective view, shown in enlarged scale, of diamond elements laid within a mold indentation in which the teeth illustrated in plan view in FIG. 1 are manufactured.

FIG. 3 is a front elevational view of FIG. 2.

FIGS. 5*a*–5*e* are diagrammatic views of new and used portions of triangular prismatic diamond cutting elements defining the type of used diamond.

FIG. 7 is front elevational view of a one-point mold setting.

FIG. 9 is a cross-sectional view of a diagrammatic mold setting used for gage protection.

FIG. 10 is a diagrammatic cross-sectional view of diamonds set in a mold for manufacture of gage protection teeth.

FIG. 11 is a plan elevational view of a mold setting of the teeth of FIGS. 9 and 10 arranged to provide gage protection.

The invention and its various elements may be better understood by now turning to the following detailed description.

DETAILED DESCRIPTION OF THE PREFERRED EMBODIMENTS

The invention is a method and structure for increasing the effective diamond exposure of a diamond cutting tooth on a drag bit which is comprised of the steps of setting a plurality of diamond elements one behind each other with respect to the direction of cutting so that each of the elements is angularly or spatially offset with respect to the preceding element in order to present a portion of the diamond element in a nonoverlapping relationship with the adjacent diamond elements. What results is a tooth structure with an effectively wider or larger diamond width available for cutting than would otherwise be possible.

Moreover, the method of the invention is particularly adapted to fabricating effective cutting teeth through the use of used diamond elements without any substantial penalty resulting from the employment of used diamond elements.

A diamond cutting tooth for use in a petroleum drag bit is provided with an extended and expanded effective diamond cutting surface by providing a linear sequence of triangular prismatic, synthetic, polycrystalline, diamond cutting elements generally along the line of direction of cutting within each tooth. Each element is offset from the preceding element in the sequence in a direction nonparallel to the line of cutting. More particularly, equilateral triangular prismatic diamond elements are laid within a V-shaped groove within a mold from which the cutting tooth is molded through conventional infiltration matrix techniques. The apical opening of the groove is 70 degrees, whereas the apical extent of each of the triangular apexes is 60 degrees. Each triangular element is laid on one side or other of the longitudinal groove. Matrix metal or binder is filled in the groove between the diamond elements thus forming a diamond cutting tooth having an effective apical dihedral angle of 70 degrees while using only 60-degree triangular prismatic elements. Worn triangular prismatic elements can be particularly adapted to this tooth structure by orienting at least one worn portion of each triangular element oriented toward the interior of the tooth with the remaining unworn point or points disposed nearest the exterior of the cutting tooth.

Figure 1:
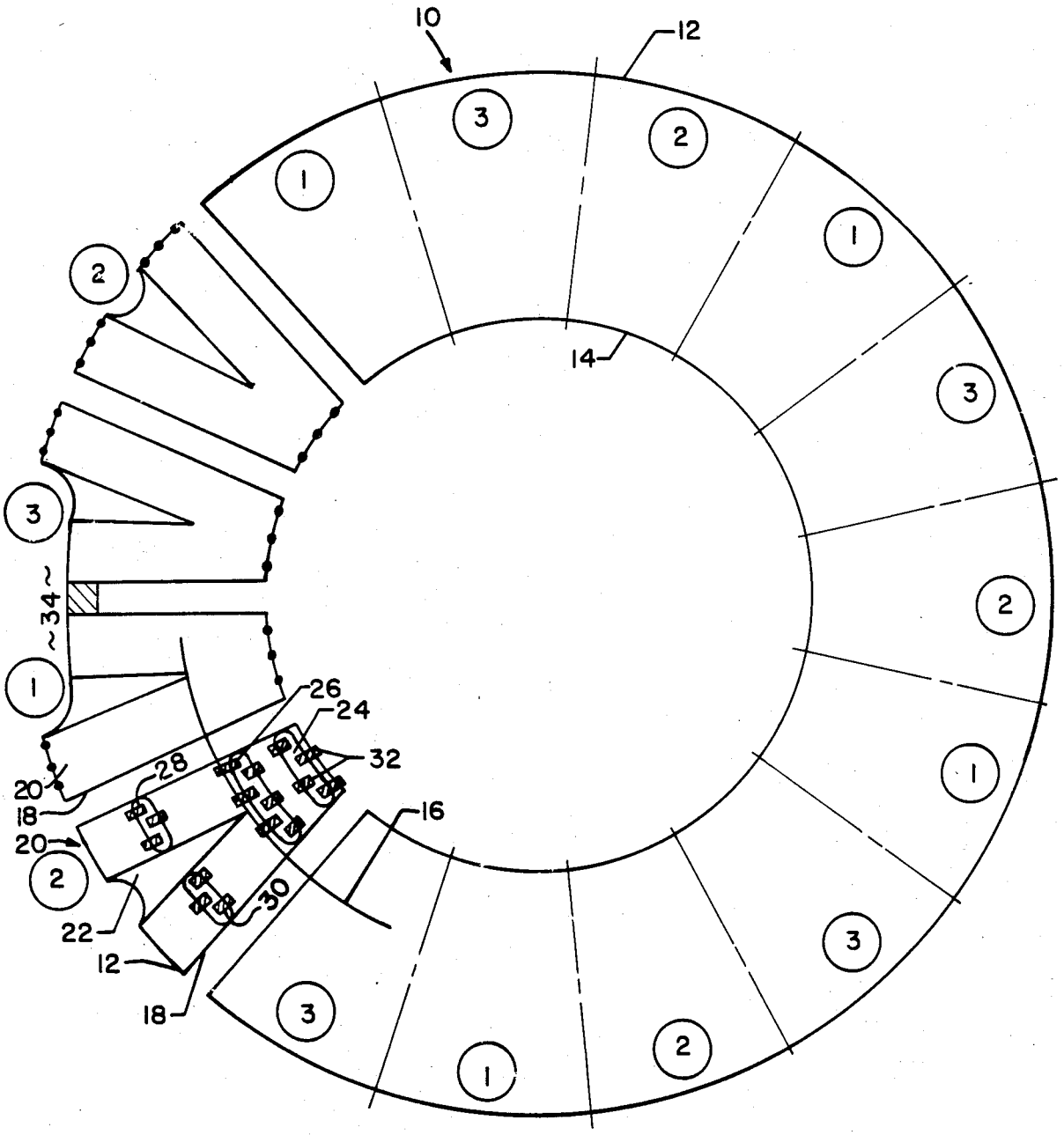
FIG. 1 is a schematic plan diagram of a petroleum drag bit incorporating the invention.

Turn specifically to FIG. 1. FIG. 1 is a plan view of a coring bit 10 characterized by an outer gage 12 and inner gage 14. Between gages 12 and 14 is a crown or face 16 of bit 10 through which a plurality of waterways 18 are defined. Between waterways 18 is a core segment, generally denoted by reference numeral 20. In the illustrated embodiment each segment 20 includes a collector 22 which generally divides segment 20 into equal halves. Each half forms a portion of the bit surface which appears in the plan view of FIG. 1 as a V-shaped segment with the apex at inner gage 14. Bit surface 16, defined by each segment 20, carries a plurality of cutting teeth of which only four are depicted in FIG. 1, namely teeth 24–30. Each tooth includes a plurality of diamond cutting elements 32, which in the present embodiment are triangular prismatic elements manufactured by General Electric Company under the trademark, GEOSET. The structure of the teeth and their method of manufacture will be described in greater detail below. Certain ones of the segments 20 fully extend to outer gage 12 while other ones of the segments terminate within a conventional junk slot 34. Each tooth 24–30 forms an elongated tooth with a longitudinal axis lying approximately on a constant radius of bit 10 and spanning a predetermined azimuthal angle.

Turn now to the perspective illustration of FIG. 2 which illustrates one of the teeth of FIG. 1, for example tooth 30, in enlarged scale as would be seen in a mold from which tooth 30 would be manufactured. The tooth as seen in FIG. 2 is inverted when viewed in its mold setting as compared to the plan view of FIG. 1 of the completed bit. Tooth 30 includes three triangular prismatic diamond elements 36–40. Each element 36–40 is disposed within a mold cavity 42. In the illustrated embodiment, diamond elements 36–40 are equilateral triangular prismatic elements and thus have opposing triangular end-faces characterized by three 60-degree corners. The side edges of each element 36–40 thus form 60-degree dihedral angles. Mold cavity 42 is formed with the use of an end mill having a 70-degree conical point. In other words, the dihedral angle defined by the opposing lateral surfaces 44*a* and 44*b* of cavity 42 from a dihedral angle in the illustrated embodiment of 70 degrees.

Therefore, according to the invention, diamond element 36 is placed within cavity 42 so that it lies in contact with one lateral side 44*a*. The next adjacent diamond element 38 is placed within cavity 42 so that it lies in contact with the opposing lateral surface 44*b* of cavity 42. Similarly, the next following diamond element, element 40, is disposed within cavity 42 so that it lies against the opposing lateral surface 44*a* of cavity 42. If the length of the tooth were extended, or similarly if the length of cavity 42 were extended, each of the next adjacent diamond teeth would be laid within cavity 42 on alternating opposing sides 44*a* or 44*b*. After diamond cutting elements 36–40 are placed within cavity 42 of the mold, the mold is filled with metallic matrix powder and furnaced according to conventional techniques to form a matrix infiltrated drag bit. The metallic matrix fills within and between elements 36–40 to form an integral and rigid tooth structure extending from bit surface 16 of segment 20.

FIG. 3 graphically illustrates the effective extension or expansion of available diamond area by virtue of the setting described in connection with FIG. 2 above. FIG. 3 is a front elevational view of tooth 30 as seen through line 3—3 of FIG. 2. The leading diamond element 36 as seen in FIG. 3 forms the leftmost portion of tooth 30 while the next adjacent subsequent element 38 forms the rightmost portion of tooth 30. Element 40 is behind diamond element 36 and thus cannot be seen in the depiction of FIG. 3 but serves as a redundant extension of the diamond element on the left side of tooth 30. Clearly in other teeth, such as teeth 24 and 26, where more than three diamond elements are employed, the redundancy is increased a number of times both on the left and right sides of each tooth.

Figure 4:
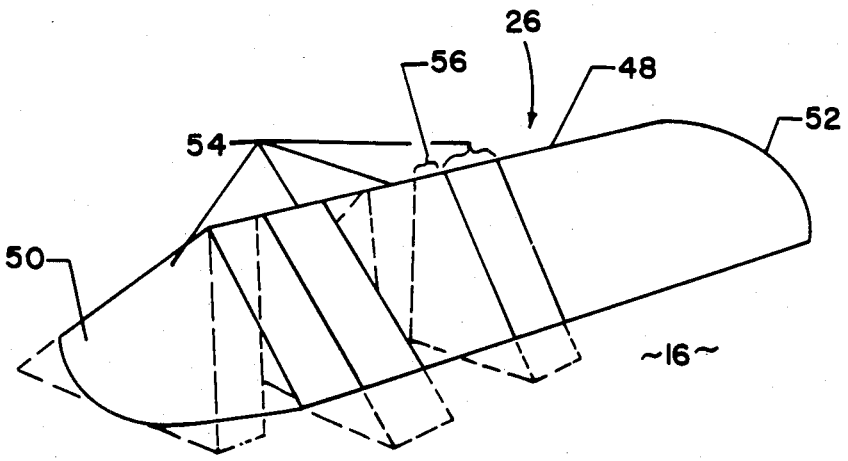
FIG. 4 is a perspective view of the completed tooth structure manufactured from the mold setting as depicted in FIGS. 2 and 3.

Turn now for example to FIG. 4 wherein tooth 26 is shown in perspective view in enlarged scale as completed following manufacture. Tooth 26 forms a raised longitudinal ridged structure above matrix surface 16 of bit 10. The structure is characterized by a radial or longitudinal apical ridge 48 with a leading matrix face 50 and a trailing matrix support 52. Embedded within tooth 26 along the length of apical ridge 48 is a plurality of diamond elements 54. Each of the plurality of diamond elements 54 is disposed within tooth 26 so that the apical edge of each triangular prismatic diamond 54 coincides and lies along apical ridge 48 of tooth 26. In the illustrated embodiment a space of approximately 0.0005 to 0.0006 mm. of matrix material is provided between each consecutive diamond element 54 within tooth 26. The amount of matrix material forming a supporting cushion and space 56 between each diamond element may be varied according to the diamond density desired in view of the rock cutting application for which bit 10 is intended.

The illustrated embodiment described above has been described in connection with new or substantially unworn prismatic diamond elements. However, the methodology and structure of teeth formed according to the invention is particularly adaptable to the advantageous use of used diamond elements without any substantial penalty with even severly worn diamonds.

For example, turn to FIGS. 5*a*–5*e*. FIG. 5*a* is a diagrammatic cross-sectional illustration of an unused or substantially unworn triangular prismatic diamond element as described in connection with the embodiment of FIGS. 2–4. FIG. 5*b* is a cross-sectional illustration of a triangular prismatic element in which one point has been worn or broken away. A used diamond element of this characteristic is described as a two-point element. Similarly, FIG. 5*c* is a cross-sectional view of a used triangular prismatic element in which two adjacent triangular points have been worn or broken away. An element characterized by the shape of FIG. 5*c* is defined as a one-point element. FIG. 5*d* is a cross-sectional illustration of a triangular prismatic element in which substantially more than 50% of one point has been worn or broken away leaving what is in effect a thin trapezoidal shape with a jagged and irregular upper surface. A used diamond element of the shape shown in FIG. 5*d* is defined as a kicker. Finally, FIG. 5*e* is a cross-sectional illustration of a diamond element which has been substantially worn away but in which one or more portions or segments of irregular shape are left embedded within the used bit. Elements having such small irregular shapes such as shown in FIG. 5*e* are defined as scrap.

According to the invention, each of the used elements as depicted in FIGS. 5*b*–5*e* can be profitably used in manufacturing of new cutting teeth. When a diamond drag bit has been used to the limit of its practical extent in the field, it is returned by the customer for salvage credit. The metal matrix bit is melted or dissolved and the diamond elements removed.

Figure 6:
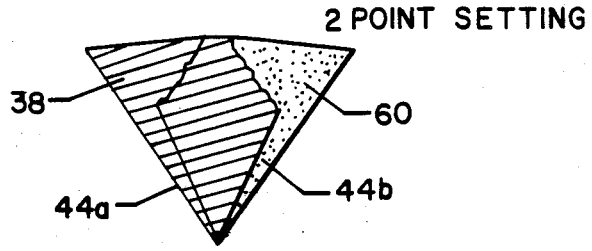
FIG. 6 is a front elevational view of a two-point mold setting.

Turn now to the depiction of FIG. 6 which is a front elevational view of a cutting tooth similar to that previously shown in connection with FIG. 3 but wherein the adjacent diamond elements 58 and 60 are two-point elements such as shown in FIG. 5*b* rather than new elements depicted in FIG. 5*a*. It may readily be appreciated that two-point elements 58 and 60 are placed within cavity 42 in a manner such that the broken point is oriented within the tooth near its base or what will become the area of its base, leaving the sharp and unused portions along apical ridge 48 and embedded in matrix surface 16 of the bit at the exterior periphery of the tooth.

FIG. 7 similarly illustrates a front elevational view similar to that of FIG. 6 in which each of the diamond elements used within the bit are one-point elements as depicted in FIG. 5*c*. In each case, the single undamaged point 62 is disposed within mold cavity 42 so that point 62 remains embedded in or below the matrix surface 16 of bit 10 of the completed tooth. The undamaged dihedral sides of each point 62 thus form the base and outer sides of the diamond elements in the tooth. In other words, one of the undamaged sides of the one-point element would be laid against lateral surfaces 44*a* or 44*b* of cavity 42 while the remaining undamaged side is placed uppermost extending from the mold cavity (embedded lowermost in the completed tooth manufactured therefrom).

Figure 8:
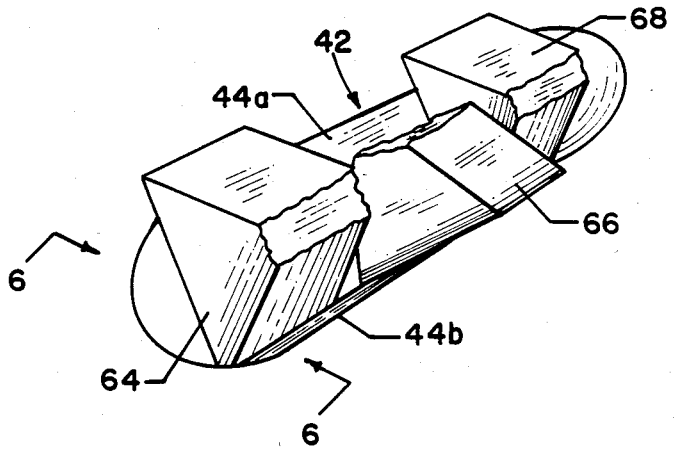
FIG. 8 is a perspective view of a two-point used diamond elements in a mold setting used to manufacture teeth such as shown in FIG. 1.

Fabrication of tooth structure employing used diamond elements is better understood by now turning to the perspective view of FIG. 8 which is similar to the view of FIG. 2 described above. In FIG. 8 three two-point elements 64–68 have been placed within mold cavity 42 in the manner depicted in connection with FIG. 6. One undamaged dihedral edge of two-point elements 64–68 is placed along apical edge 48 within cavity 42 and the remaining dihedral edge is placed uppermost as depicted in FIG. 8. The undamaged surface between two undamaged points is thus appropriately laid against the lateral surface 44*a* or 44*b* as appropriate. The damaged point is therefore oriented to be placed within the interior and near the base of the tooth. The three two-point elements are alternately laid in cavity 42 in the same manner described above in connection with FIG. 2 which results in essentially the same type of tooth as depicted in FIG. 4.

The kicker and scrap elements may be usefully employed according to the invention within the gage protection teeth defined within inner gage 14 or outer gage 12.

Turn to FIG. 9 wherein a cross-sectional view of a plurality of longitudinal broaches 70 is defined within a mold for bit 10 and into which kicker or scrap elements 72 have been placed. In the case where kicker elements such as depicted in FIG. 5*d* are employed, elements 72 are placed in an edgewise fashion within broaches 70 to orient a side surface of the trapezoidal shape as the uppermost diamond portion. This will allow the maximum exposure and amount of diamond material of each kicker element 72 to be made available to each gage protection tooth. Scrap such as shown in FIG. 5*e* can be similarly be oriented within broaches 70 according to the same principle in order to maximize the amount of diamond material made available for wear within the broach tooth.

FIG. 10 similarly illustrates a cross-sectional view of broaches 70 defined within gage portion of the mold bit 10 into which two- or one-point elements as depicted in FIGS. 5*b* and 5*c*, respectively, have been disposed. The two- or one-point element is placed within broach 70 so as to orient the worn point or points within broach 70, thus providing the broken surface of the element as the uppermost available diamond portion in the gage protection tooth. It is also possible that the two- or one-point element could be similarly oriented to placed one of the undamaged points within broach 70 of the mold.

FIG. 11 is a simplified plan elevational view of broaches 70 as seen in the mold illustrating how both kicker and scrap material, and one- or two-point material may be combined within gage protection teeth.

Many other alterations and modifications may be made by those having ordinary skill in the art without departing from the spirit and scope of the invention. For example, although a coring drag bit has been illustrated in connection with FIG. 1 it is to be expressly understood that any other type of drill bit incorporating diamond teeth could have similarly been shown and may be appropriately combined with teeth for the present invention. In addition, although the illustrated embodiment has been described in connection with triangular prismatic elements, the principles illustrated with respect to the the use of this geometric shape could also be extended to other geometric shapes. Further, the illustrated embodiment has been similarly described in connection with synthetic diamond elements, but the principles of the invention apply with equal applicability to any type of cutting element including natural diamond elements, tungsten carbide elements, boron nitride elements and the like. In addition the invention has been illustrated in connection with a specific type of tooth design, namely a full ridge tooth. It is to be expressly understood that many other tooth structures could also incorporate the invention without departing from its scope.

The illustrated embodiment has been shown only for the purposes of example and it should not be taken as limiting the invention as defined in the following claims.

I claim:

1. A cutting tooth for use in a drill bit having a bit surface, said tooth characterized by a cutting direction, comprising:

a single tooth body raised above said bit surface; and a plurality of cutting elements disposed within said body, said plurality of cutting elements forming a sequence of elements extending along said cutting direction of said cutting tooth, each cutting element of said sequence including at least a portion of said element extending in a nonparallel direction to said cutting direction and having a nonoverlapping projection in said cutting direction with respect to the preceding cutting element within said sequence to define a nonoverlapping extent of said element, whereby the effective area of said cutting elements made available for cutting action within said tooth is substantially increased over that area available from a single one of said cutting elements.

2. The cutting tooth of claim 1 wherein said body is composed of metal matrix and wherein each of said plurality of cutting elements is separated one from each other by a thickness of said metal matrix.

3. The cutting tooth of claim 1 wherein each of said plurality of cutting elements is separated by a portion of said body along said cutting direction.

4. The cutting tooth of claim 1 wherein at least two of said cutting elements have a triangular prismatic shape, and wherein the apical edge of said at least two triangular prismatic shaped elements disposed within said body are parallel to each other.

5. The cutting tooth of claim 4 wherein said at least one apical edge of each said plurality of triangular prismatic elements lies generally on a line, with each remaining apical edge of said triangular prismatic elements being nonaligned with at least one other one of said plurality of triangular prismatic elements.

6. The cutting tooth of claim 1 wherein said body has an exterior surface and an interior volume, and wherein at least two of said cutting elements are elements having at least one worn portion, each element disposed within said body to orient said worn portion within said body away from the exterior surface of said body so that only unworn portions comprise said nonoverlapping extent of each of the said elements.

7. The cutting tooth of claim 6 wherein at least two of said cutting elements are triangular prismatic elements characterized by three apical dihedral edges with at least one of said dihedral edges worn away, said worn elements disposed within said body to orient said at least one wornaway apical edge into said interior volume of said body.

8. A cutting tooth for use in a drill bit having a bit surface comprising:

a single body raised above said bit surface having an exterior and interior and characterized by a line of cutting defined by the direction of movement of said body when said drill bit is drilling;

a plurality of cutting elements disposed within said body in a sequence along said line of cutting, each cutting element offset with respect to the preceding cutting element to expose at least a portion of said cutting element beyond said preceding cutting element as viewed along said line of cutting, whereby the effective area of said plurality of cutting elements is substantially increased over that available from a single one of said cutting elements.

9. The cutting tooth of claim 8 wherein each cutting element is a triangular prismatic element having two opposing triangular faces and three dihedral edges connecting said opposing triangular faces, said triangular prismatic elements forming a sequence of spaced-apart offset elements within said body.

10. The cutting tooth of claim 9 wherein at least one of said dihedral edges of each of said plurality of cutting elements lies along a common line.

11. The cutting tooth of claim 10 wherein said common line is defined by and parallel to said line of cutting.

12. The cutting tooth of claim 11 wherein each of said triangular prismatic cutting elements is perpendicularly offset from said common line with the exception of said dihedral edge of said cutting element lying on said common line.

13. The cutting tooth of claim 8 wherein each of said cutting elements has a portion of said element worn away, said worn-away portion oriented toward said interior of said body.

14. The cutting tooth of claim 9 wherein each of said cutting elements has a portion of said element worn away, said worn-away portion oriented toward said interior of said body, and wherein said worn-away portion is at least one apical edge of said triangular prismatic element.

15. The cutting tooth of claim 12 wherein each of said cutting elements has a portion of said element worn away, said worn-away portion oriented toward said interior of said body, and wherein said worn-away portion is at least one apical edge of said triangular prismatic element.

16. A method for fabricating in a mold a cutting tooth on a bit surface with an enhanced cutting area on the bit comprising the steps of:

making an indentation in a mold surface;

disposing a first cutting element in a mold indentation, said indentation forming, when filled with matrix material and furnaced, a single tooth body raised above a bit surface of the bit defined by the surface of said mold into which said indentations are provided;

disposing additional cutting elements within said indentation azimuthally behind said first cutting element, each additional cutting element radially offset from at least one preceding cutting element disposed within said indentation, each of said cutting elements disposed within said indentation forming part of said single tooth raised above said bit surface of said bit;

filling the mold with metallic matrix powder to form said bit and bit surface;

said powder fixing said sequence of offset cutting elements to form said tooth body raised above said bit surface of said bit; and furnacing said filled mold to form a solid metallic bit, said single tooth body raised above said bit surface integrally extending from said bit surface.

* * * * *